US005671849A

United States Patent [19]

Bacon

[11] Patent Number: 5,671,849

[45] Date of Patent: Sep. 30, 1997

[54] DISPLAY UNIT HAVING DETACHABLE ITEM HOLDERS

[76] Inventor: Debrah Kay Bacon, 6437 W. Riverchase Dr., Tampa, Fla. 33637

[21] Appl. No.: 515,300

[22] Filed: Aug. 15, 1995

[51] Int. Cl.[6] ..... A47F 7/00

[52] U.S. Cl. ..... 211/13; 211/87; 248/205.2; 206/6.1

[58] Field of Search ..... 211/13, 89, 87, 211/DIG. 1; 312/245, 246; 206/6.1, 566, 806, 495; 248/205.2, 206.5, 220.31; D6/467, 310; 40/729

[56] References Cited

U.S. PATENT DOCUMENTS

| | | | |
|---|---|---|---|
| 2,290,468 | 7/1942 | Godfrey | 211/123 |
| 3,258,237 | 6/1966 | Beiman | 211/DIG. 1 X |
| 3,262,479 | 7/1966 | Leguillon | 248/206.5 X |
| 3,370,818 | 2/1968 | Perr | 248/205.2 |
| 3,415,300 | 12/1968 | Worcester | 248/205.2 X |
| 4,281,469 | 8/1981 | Feibelman | 206/566 X |
| 4,327,837 | 5/1982 | Ross | 248/205.2 X |
| 4,401,219 | 8/1983 | Mink | 206/6.1 X |
| 4,413,736 | 11/1983 | Nibling | 206/6.1 X |
| 4,420,084 | 12/1983 | Whelan | 206/6.1 X |
| 4,735,246 | 4/1988 | Niehaus | 206/6.1 |
| 4,749,604 | 6/1988 | Foster | 248/205.2 X |
| 4,767,011 | 8/1988 | Butler | 211/13 |
| 4,771,897 | 9/1988 | Ho | 211/13 |
| 4,799,587 | 1/1989 | DeSanto | 248/205.3 X |
| 4,905,821 | 3/1990 | Corbett | 206/6.1 X |
| 4,923,069 | 5/1990 | Germain et al. | 211/13 |
| 4,979,625 | 12/1990 | Johnson et al. | 211/DIG. 1 X |
| 5,050,745 | 9/1991 | Sanders | 211/13 |
| 5,422,803 | 6/1995 | Kilgore | 248/205.5 X |
| 5,427,230 | 6/1995 | Mattox | 206/6.1 |
| 5,511,873 | 4/1996 | Mech | 206/566 X |

*Primary Examiner*—Robert W. Gibson, Jr.

[57] ABSTRACT

A display unit for the removable attachment of holder units. The holder units retain various small objects which are associated as being used by people. Specifically disclosed are keys and jewelry items worn by both men and women. Jewelry items are normally visually inspected by the user during a selection process. During the selection process comparisons are made to select a grouping of items. Easy movement of the different items under consideration on the display unit assists the user in making a final selection. A dual member fastener, as exampled by hook and loop fasteners, is ideally suited as the connection means. One member is secured to the display unit with its respective attachment side exposed. The second member forms the holder units with its respective attachment side exposed on the back side. Utilization of the fasteners, for jewelry items, or key rings for keys, is provided for attachment of the items to the holder units. Containment of the items while detached from the display unit, and still attached to the holder units, is provided. This containment reduces the chance of loss and enhances the chance of easy recovery of the relatively small items while being transported. Flexibility of the holder units permits transport, such as in a purse, without damaging the transport device. The flexibility of the holder units provide for ease of attachment and detachment while providing for conforming around penetrating fasteners.

15 Claims, 10 Drawing Sheets

DISPLAY UNIT HAVING DETACHABLE ITEM HOLDERS

BACKGROUND

1. Field of the Invention

The present invention generally relates to display units capable of displaying various items while providing for repetitive attachment and detachment of the items. More specifically, the invention relates to an improved display system for the attractive and orderly display of items while the items are attached using detachable holders.

2. Description of the Prior Art

Various attempts have been made to provide display units capable of displaying items, such as jewelry, to allow visual inspection and selection by a person. Generally the display unit uses the item's fastener, in the case of jewelry, to facilitate attachment to a support structure. Such attachment generally is awkward to manipulate during the attachment and detachment steps.

Detachable holders are known in the art which act to hold the item or items while allowing attachment to a display box. Generally these holders are attachable only at predetermined locations, as exampled by elevated slats, on the display box. User selected random placement is not permitted with such configurations.

As such, it may be appreciated that there continues to be a need for a display unit having detachably attached holders for securing items, such as keys or jewelry, to a support surface in a user defined configuration. The present invention substantially fulfills these needs.

SUMMARY

In view of the foregoing disadvantages inherent in the known types of display units your applicant has developed a display unit having a frame with a support surface disposed generally within the frame. At least one piece of one member of a dual member detachable fastener, such as a hook and loop fastener, is rigidly fixed to the support surface. Holder units made of the second member of the dual member detachable fastener, or having sections of the second member attached thereto, are utilized to hold various items, such as keys or jewelry. The holder units are releasable attached to the first member of the dual member detachable fastener for display. The holder units are selectively moveable by the user on the display unit while the items remain attached to the holder units. Following detachment, the holder units may be transported with the items securely attached thereto. Flexibility of the holder units ensure contact and adhesion to the display unit. Due to the transportability of the detached holder units, soiling is possible. The holder units are washable without any discernable loss of attachment power.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposed of the present invention. It is important, therefore, that the claims be regarded as including such equivalent constructions insofar as they do not depart from the spirit and scope of the present invention.

The primary object of the present invention is to provide a display unit for storing and displaying a plurality of items wherein the items may be easily attached and detached.

Other objects include;

a) to provide a display unit for displaying a plurality of items wherein the user may arrange the individual items in a desired placement on the display unit.

b) to provide attachment members capable of repetitive attachment and detachment from the display unit.

c) to provide for attachment of cooperating items to an attachment member to permit containment of the cooperating items while in a detached state from the display unit.

d) to provide for an intermediate holder unit to permit selection and detachment of several different items attached to separate holder units as a group while providing for containment of the group while in a detached state from the display unit.

e) to provide for various specialized holder units to contain specific classes of items.

f) to provide for ease of removal of a holder unit from the display unit by providing for an easily accessible gripping area on the holder unit.

g) to provide for an economical substitute for the commercially produced hook material of a hook and loop fastener.

h) to provide for flexible holder units to ensure conforming qualities during attachment and detachment.

i) to provide for a portable unit having mounting means, as exampled by suction cups, for temporary placement attachment.

j) to provide for the display units to have various shapes including rectangular, square, oval, circular and heart shaped.

k) to provide for the ability to remove an item and visually inspect that item comfortably while manipulating the item for proper distance and lighting conditions.

l) to provide for decorative trimming, such as molding or a fabric braiding, to surround the display unit to enhance aesthetic appeal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
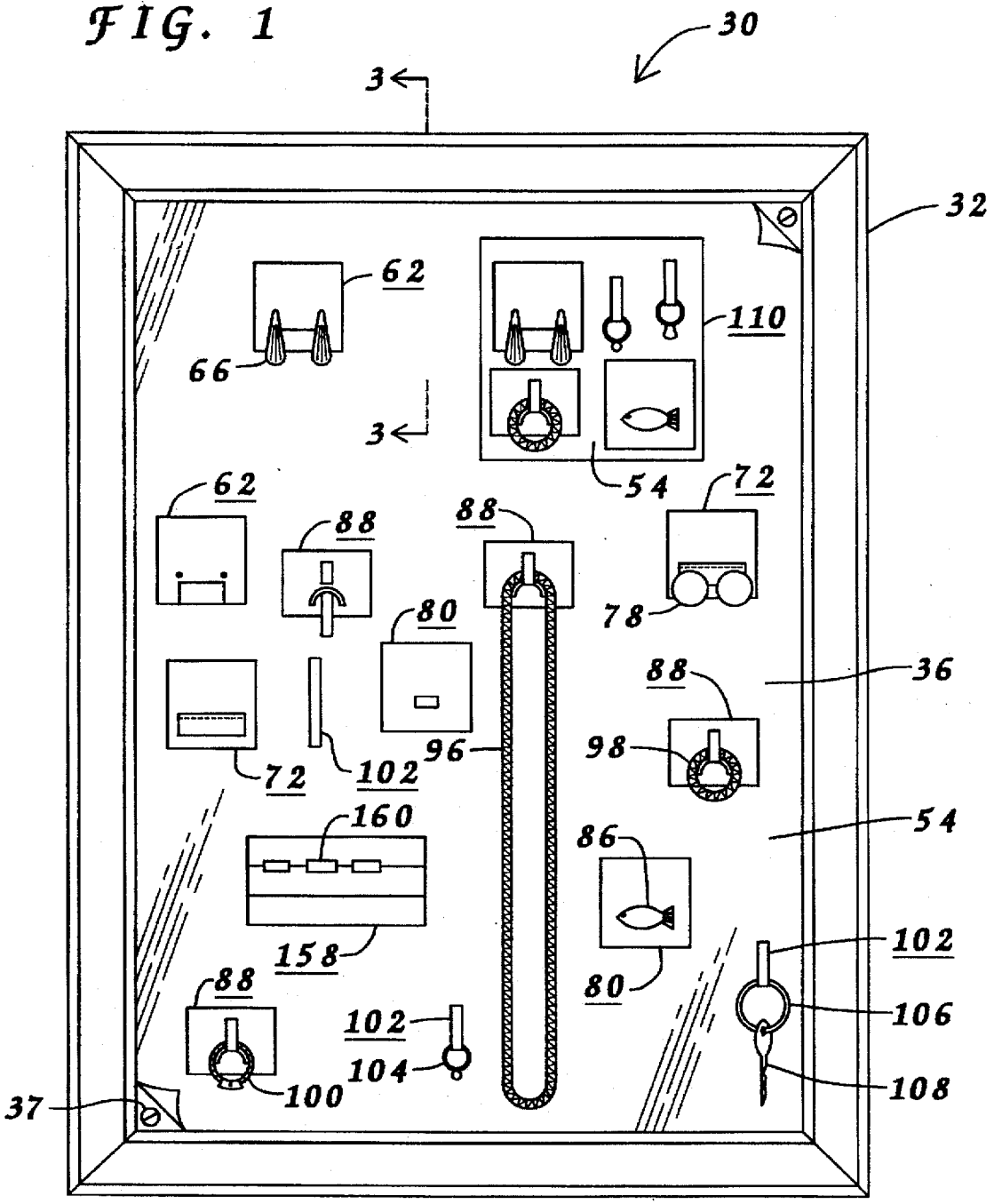
FIG. 1 is a front elevational view of a display unit.
Figure 2:
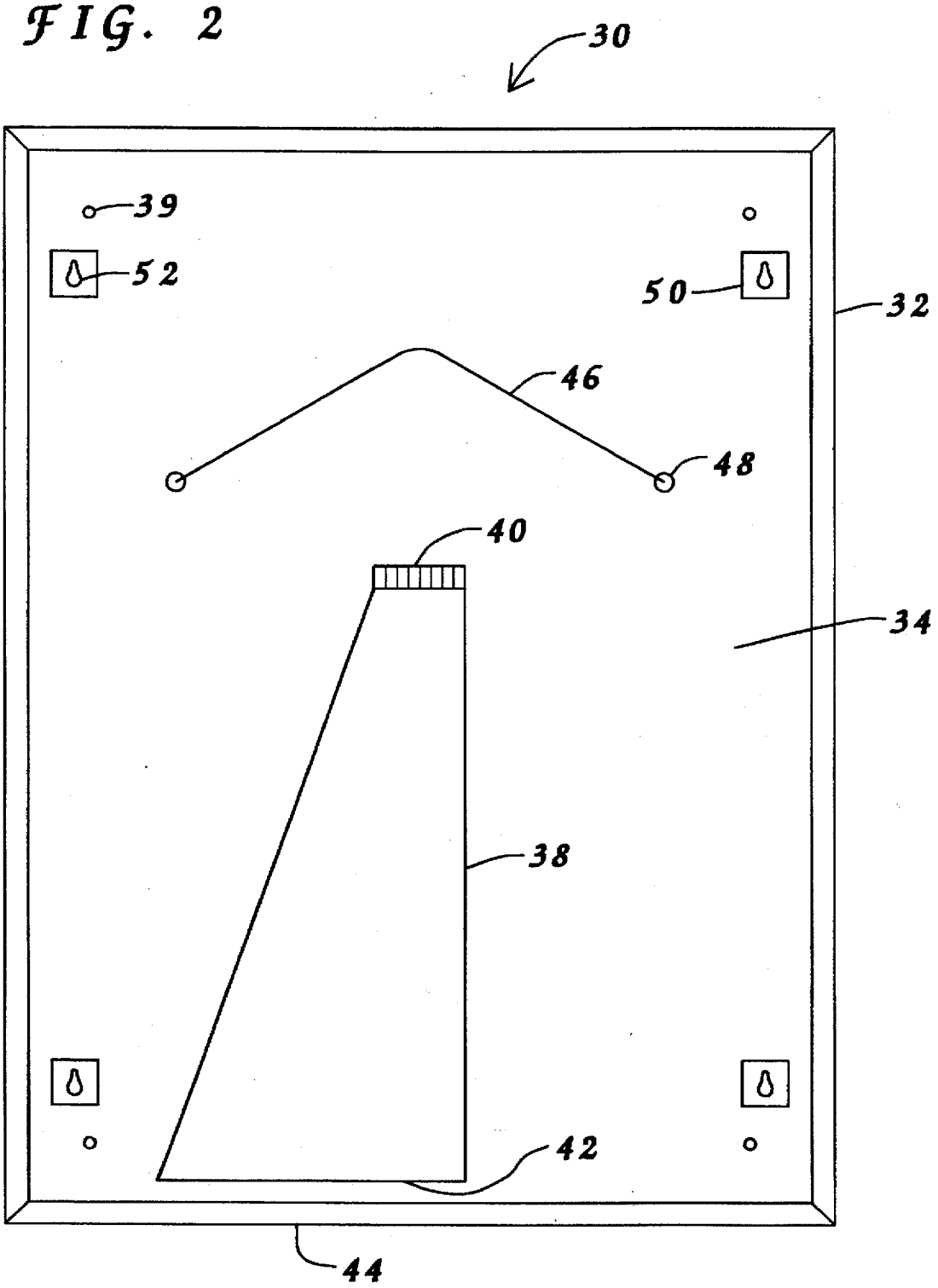
FIG. 2 is a rear elevational view of the display unit shown in FIG. 1.
Figure 3:
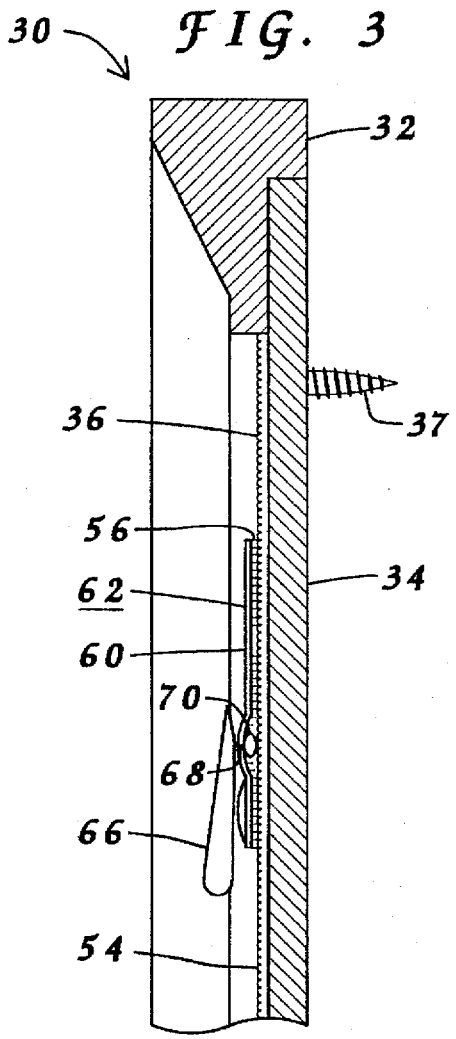
FIG. 3 is a sectional view taken from the section lines shown in FIG. 1.

Referring now to the drawings where like reference numerals refer to like parts throughout the various views, and specifically referring to FIG. 1 through FIG. 3. A display unit 30 is comprised of a frame 32 and a base panel 34. Frame 32 defines a perimeter of display unit 30 while providing for aesthetic appeal. Base panel 34 has a facing side forming a support surface 36 and a rearward side permitting attachment of a select placement mounting unit.

Various placement mounting units are available, as exampled in FIG. 1, FIG. 2 and FIG. 3, for stationary placement of display unit 30 by a user. A first example places display unit 30 on a generally horizontal surface such as a table, not shown, utilizing a pivotal panel 38. Pivotal panel 38 is pivotally affixed to base panel 34 using a hinge 40. Pivotal panel has a base edge 42 which cooperates with a display base edge 44 to support display unit 30 at a predetermined angular position on the horizontal surface.

Additional examples attach display unit 30 to a generally vertical surface such as a wall, not shown. A first example of such placement utilizes a mounting wire 46 attached to base panel 34 using opposing wire anchors 48. A second example utilizes a plurality of mounting members 50 each having a slot 52. Mounting wire 46 or slot 52 would receive a screw or nail anchored to the vertical surface, not shown, and hold display unit 30 affixed to the vertical surface. Still another example utilize a plurality of screws 37 which penetrate display unit 30 and anchor to the wall, not shown. Screws 37 are illustrated as being placed in the four corners on support surface 36 using screw holes 39 and covered by loop material 54 following securement. Penetration of the border of frame 32 is equally possible.

Display unit 30 has the function of retaining for display and selection by the user various attached jewelry items or other small items used by people. Several features or functions are required to practice the invention. First, is that the individual items displayed must be mountable and dismountable repeatedly without requiring an unacceptable amount of pulling pressure to remove the item from display unit 30. Additionally there must not be a discernible loss of retaining power following repeated repetitions of mounting and dismounting of the individual items. Further their must be sufficient retaining power to secure the individual items while support surface 36 of display unit 30 is in a generally vertical orientation.

A fastener having two opposing parts fulfills the above defined requirements as exampled by a hook and loop fastener. A loop material 54 covers support surface 36, shown in FIG. 1 and FIG. 3. Various item holders, as exampled by an earring holder unit 62, have a backing formed of a hook material 56. Hook material 56 will attach itself to loop material 54 when they come into contact. The use of this particular opposing member fastener is particularly desirable due to the flexibility of both members of the fastener. As exampled in FIG. 1 and FIG. 3 loop material 54 completely covers and is secured and fixed to base panel 34 using a glue, not shown.

As detailed below, sectional or intermittent coverage is possible. Removal of the detachable member of the fastener is simplified by the physical characteristic associated with flexibility of being able to peel the detachable member away from the fixed member.

The physical quality of being flexible is desirable within the holder units for several reasons. Ease of attachment, ease of detachment, the ability to conform around penetrating fasteners of the attached items or the overlapping of other holder units and the lack of sharp rigid corners which may damage containers, such as purses, are along these reasons.

A commercially produced loop material of a hook and loop fastener or, in the alternative, a tightly woven material as exampled by a heavy duty commercial grade carpet can form loop material 54. Such use of an inexpensive substitute material to provide the function of the commercially produced loop material will significantly reduce production costs for display units.

The use of hook material to directly form the various item holders is particularly expedient as compared to attaching hook material to a substrate material. Such direct use of hook material can be complimented by fabric material attached to the exposed surface of the hook material to satisfy aesthetic preferences.

Loop material is disclosed as the covering forming support surface 36 and hook material is disclosed as forming the backing of the various item holders. Reversal of this placement is possible, and in several applications, may be preferred.

Various item holders are shown in FIG. 1 with enlarged views of the individual holders shown in FIG. 3 through FIG. 12 and FIG. 19. The various holder units have a contact side 58 formed of hook material 56 and a base side 60 which is a backing substrate material.

Figure 4:
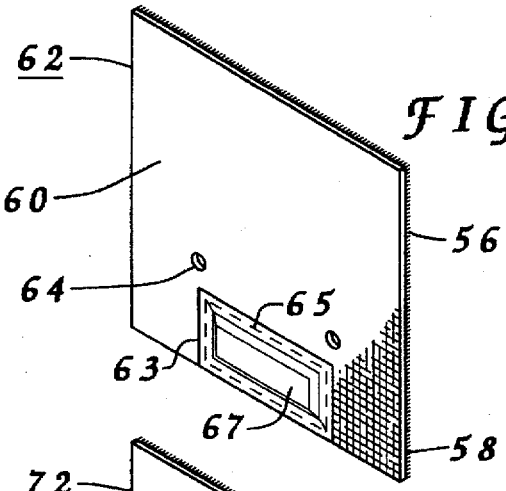
FIG. 4 is a perspective view of an earring holder unit.

Earring holder unit 62, shown in FIG. 1, FIG. 3 and FIG. 4, is capable of retaining a pair of pierced type earrings 66. FIG. 3 illustrates the conforming properties of item holders formed of a flexible material. Pierced type earring 66 has a shaft 68 and a connector 70. When worn, shaft 68 extending through a penetrating hole in the wearer's ear lobe, not shown, and is retained therein using connector 70. A pair of penetrating apertures 64 extend from base side 60 to contact side 58 of earring holder unit 62. The fastening assembly of pierced type earring 66 is utilized to attach pierced type earring 66 to earring holder unit 62 using penetrating apertures 64.

Earring holder unit 62 additionally is capable of retaining a pair of clip on type earrings using a clip pad 63. Clip pad 63 is attached to earring holder unit 62 utilizing a stitching 65 and forms a raised area 67. As conventionally known in the art, clip on type earrings are worn by fastening them to the earlobe. Sufficient pressure to tightly clamp the opposing clip members together when not being worn is generally not desired due to wearer discomfort. Raised area 67 approximates the normal clip strength and provides sufficient resistance to retain clip type earrings thereto.

Hook material 56 of the various holder units engage loop material 54 of display unit 30 to attach the individual holder units securely. Complete contact by contact side 58 to loop material 54 of support surface 36 is not required for this attachment. Additionally casual contact is all that is required between contact side 58 and support surface 36 without necessitating excessive pressure being applied by the user.

The commercially available hook material is a particularly expedient choice to fashion the various holder units from due to the flexibility yet resilient construction associated with this material. This approach has hook material completely covering the contact side of the various holder units. Another approach is to form a substrate from material having similar resilient yet flexible qualities. Smaller pieces of the commercially available hook material may then be attached to the contact side of this substrate. This would significantly reduce production cost as other suitable materials are less expensive than the commercially available hook material. An advantage of this approach resides in the ability to vary colors, or incorporate decorative patterns thereon, for the base side of the holder unit. This permits holder units which compliment the color selection of support surface 36 of display unit 30.

Figure 5:
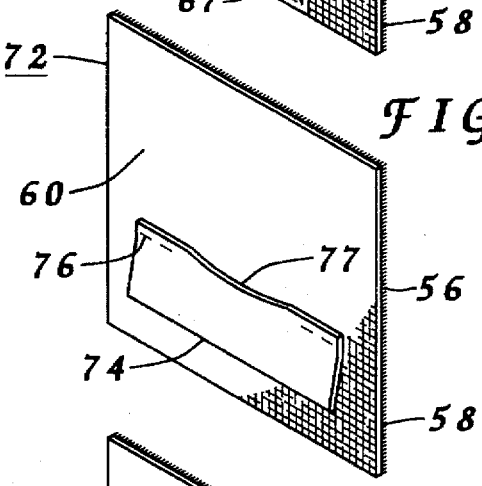
FIG. 5 is a perspective view of a second embodiment of an earring holder unit.

An earring holder unit 72, shown in FIG. 1 and FIG. 5, is capable of retaining for display clip type earrings 78. An extending flap 74 is attached to earring holder unit 72 using a stitching 76. For the reasons set forth above extending flap 74 may have a padding material installed therein to approximate the thickness and consistency of an ear lobe. In the alternative, an opening 77 may be left between extending flap 74 and base side 60. Opening 77 may then accept connection of the clip, not shown, while providing additional retaining properties.

Figure 6:
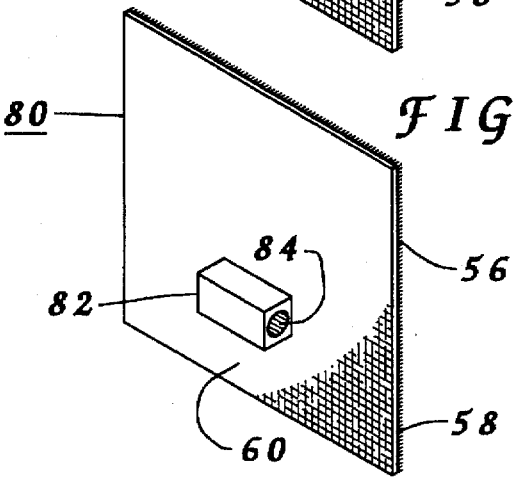
FIG. 6 is a perspective view of a pin holder unit.

A pin holder unit 80, shown in FIG. 1 and FIG. 6, is capable of retaining for display a pin 86 having an ornamental design. Pin 86 has a retaining member, not shown, comprising a pivotal needle and a clasp, as conventionally known. A connection unit 82, having an aperture 84 penetrating therethrough, is secured to pin holder unit 80. During attachment the pivotal needle, not shown, is inserted through aperture 84 and secured by the clasp, not shown.

Figure 7:
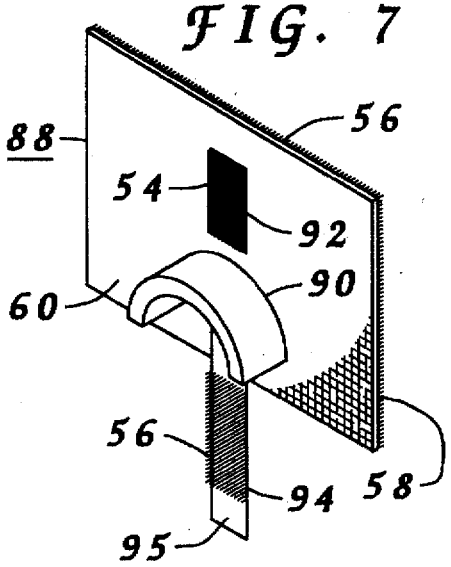
FIG. 7 is a perspective view of a loop item holder unit illustrated in an open position.
Figure 8:
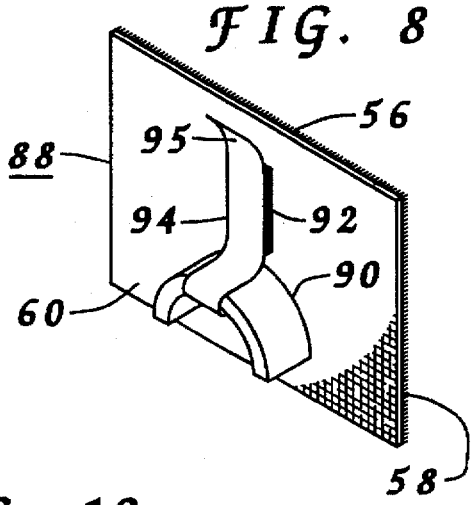
FIG. 8 is a perspective view of the loop item holder unit shown in FIG. 8 illustrated in a closed position.

A loop item holder unit 88, shown in FIG. 1, FIG. 7 and FIG. 8, is capable of retaining a select one of the numerous items of loop jewelry. Examples of loop jewelry include necklace 96, bracelet 98 and watch 100, all shown in FIG. 1. A support platform 90 being generally arched shaped is secured to base side 60 of loop item holder unit 88. A fastening strip 92 having an exposed surface of loop material 54 is fixed to base side 60 of loop item holder unit 88 adjacent to and to one side of support platform 90. A fastening strap 94 having hook material 56 attached thereto is fixed at one end to base side 60 of loop item holder unit 88 adjacent to and to the opposing side of support platform 90. The distal end of fastening strap 94 forms a grip 95. Grip 95 does not have coverage by hook material 56 and therefore will not adhere to loop material 54 of fastening strip 92. FIG. 7 shows loop item holder unit 88 in an open position. FIG. 8 shows loop item holder unit 88 in a closed position. Hook material 56 of fastening strap 94 is in contact with and secured to loop material 54 of fastening strip 92 to secure the respective loop item to loop item holder unit 88.

Figure 9:
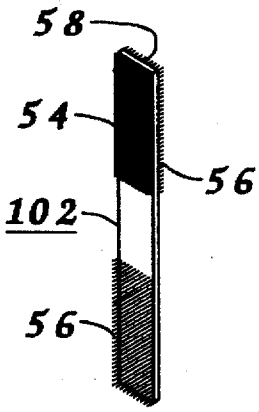
FIG. 9 is a front perspective view of a ring holder unit.
Figure 10:
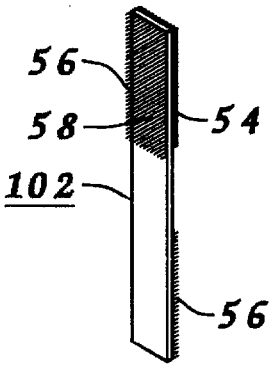
FIG. 10 is a rear perspective view of the ring holder unit shown in FIG. 9.
Figure 12:
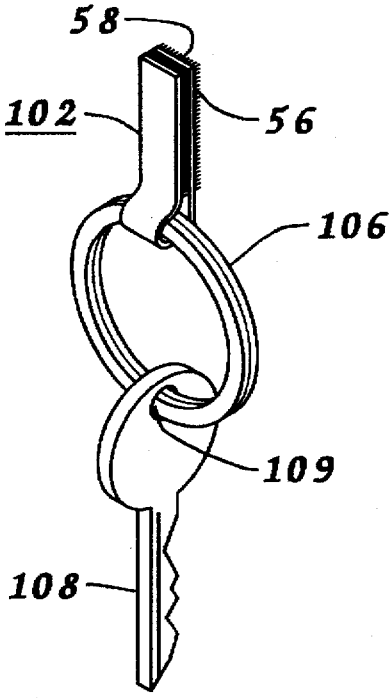
FIG. 12 is a perspective view of the ring holder unit shown in FIG. 9 and FIG. 10 holding a key ring.
Figure 11:
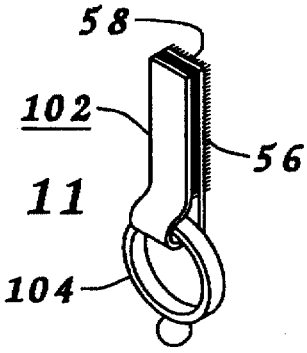
FIG. 11 is a perspective view of the ring holder unit shown in FIG. 9 and FIG. 10 holding a ring.

A ring holder unit 102, shown in FIG. 1 and FIG. 9 through FIG. 12, is capable of retaining rings including rings used to retain keys. Key 108 has an attachment member being a penetrating aperture 109. FIG. 9 shows a front view while FIG. 10 shows a rear view. Ring holder unit 102 is an elongated piece of material having a front and a back and opposing ends. The front of ring holder unit 102 has the opposing members of the opposing fastener fixed to the opposing ends of ring holder unit 102. As illustrated, loop material 54 is securely fixed to the upper end while hook material 56 is securely fixed to the lower end. By bringing the lower end up to bring hook material 56 into contact with loop material 54 a small closed loop item may be secured. A ring 104, an example of a small closed loop item, is shown secured to ring holder unit 102 in FIG. 11. The rear of ring holder unit 102 has hook material 56 securely fixed to the upper end. Hook material 56 engages loop material 54 of display unit 30, as shown in FIG. 1. Similarly a key ring 106, having at least one key 108, can be held by ring holder unit 102, as shown in FIG. 1 and FIG. 12.

Figure 19:
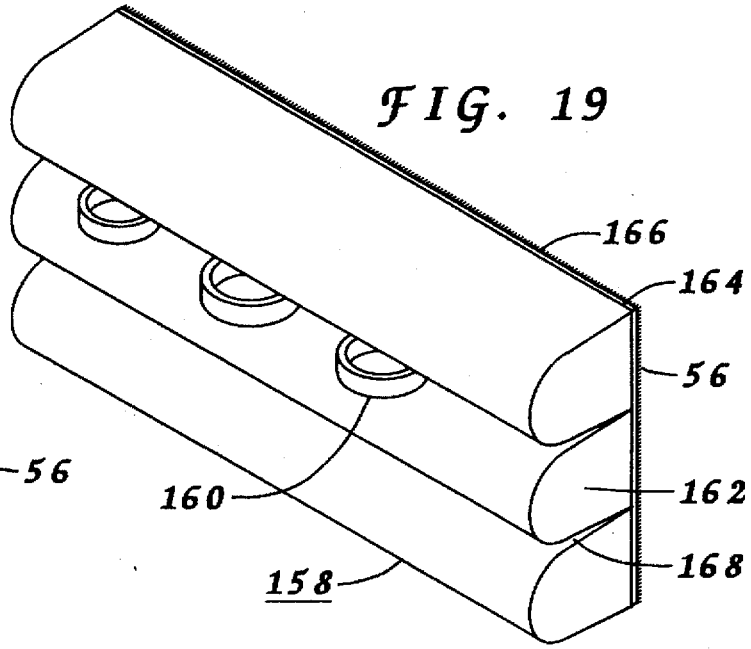
FIG. 19 is a perspective view of a key holder unit.

A ring holder 158, shown in FIG. 1 and FIG. 19, is capable of retaining a plurality of rings 160. A backing 164 has attached thereto hook material 56 and forms a contact side 166 which acts to permit attachment to support surface 36 of display unit 30. Backing 164 has attached thereto on the opposing side from contract side 166 a plurality of bridges 162. Bridges 162 are covered with a compressible material and are situated in close proximity one to the other. Such positioning results in the forming of a holding slot 168 between each adjacent set of bridges 162. Each holding slot 168 is of sufficient length to receive a plurality of rings 160. Due to the compressibility of the material attached to bridges 162, rings 160 are held securely therein.

Figure 21:
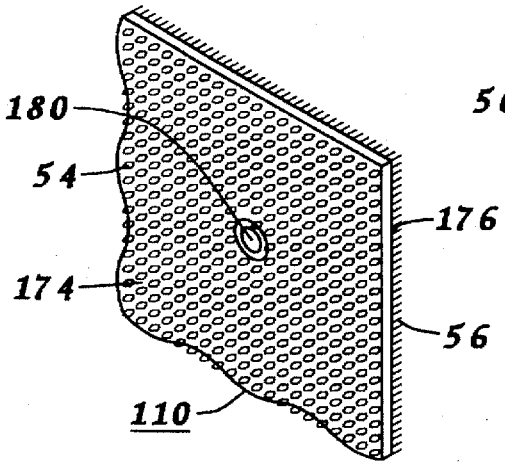
FIG. 21 is a front sectional perspective view of a corner of an intermediate holder.
Figure 22:
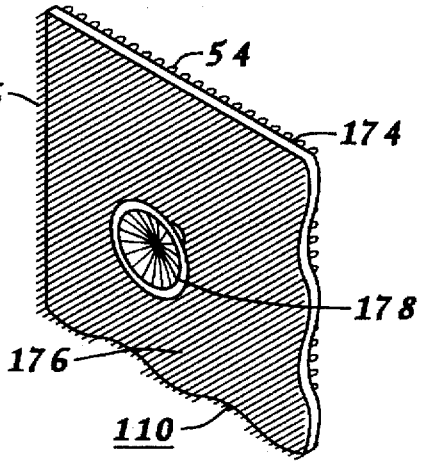
FIG. 22 is a rear sectional perspective view of the intermediate holder shown in FIG. 21.

An intermediate holder 110, shown in FIG. 1, FIG. 21 and FIG. 22, is a flexible sheet of material having loop material 54 on a holder unit mounting side 174 and hook material 56 on an attachment side 176. Thus, a selection of items held on individual holder units, as shown in FIG. 1, may be applied to holder unit mounting side 174. Holder unit mounting side 174 is the exposed side during attachment to support surface 36 of display unit 30. If desired, the entire selection may be removed from display unit 30 and transported while the selected items remain confined to intermediate holder 110. As shown in FIG. 21 and FIG. 22, attachment members, a suction cup 178 attached using a connector 180, may be secured to the rearward side of intermediate holder 110. These attachment members would be attached in each of the corners. Suction cups 178 could then be used to rigidly mount intermediate holder 110 to a detached smooth mounting surface, such as a mirror, not shown.

Display unit 30, shown in FIG. 1, has loop material 54 completely covering and forming support surface 36. Alternatively it is possible to provide partial coverage of the support surface with loop material 54 to reduce production expense.

Figure 13:
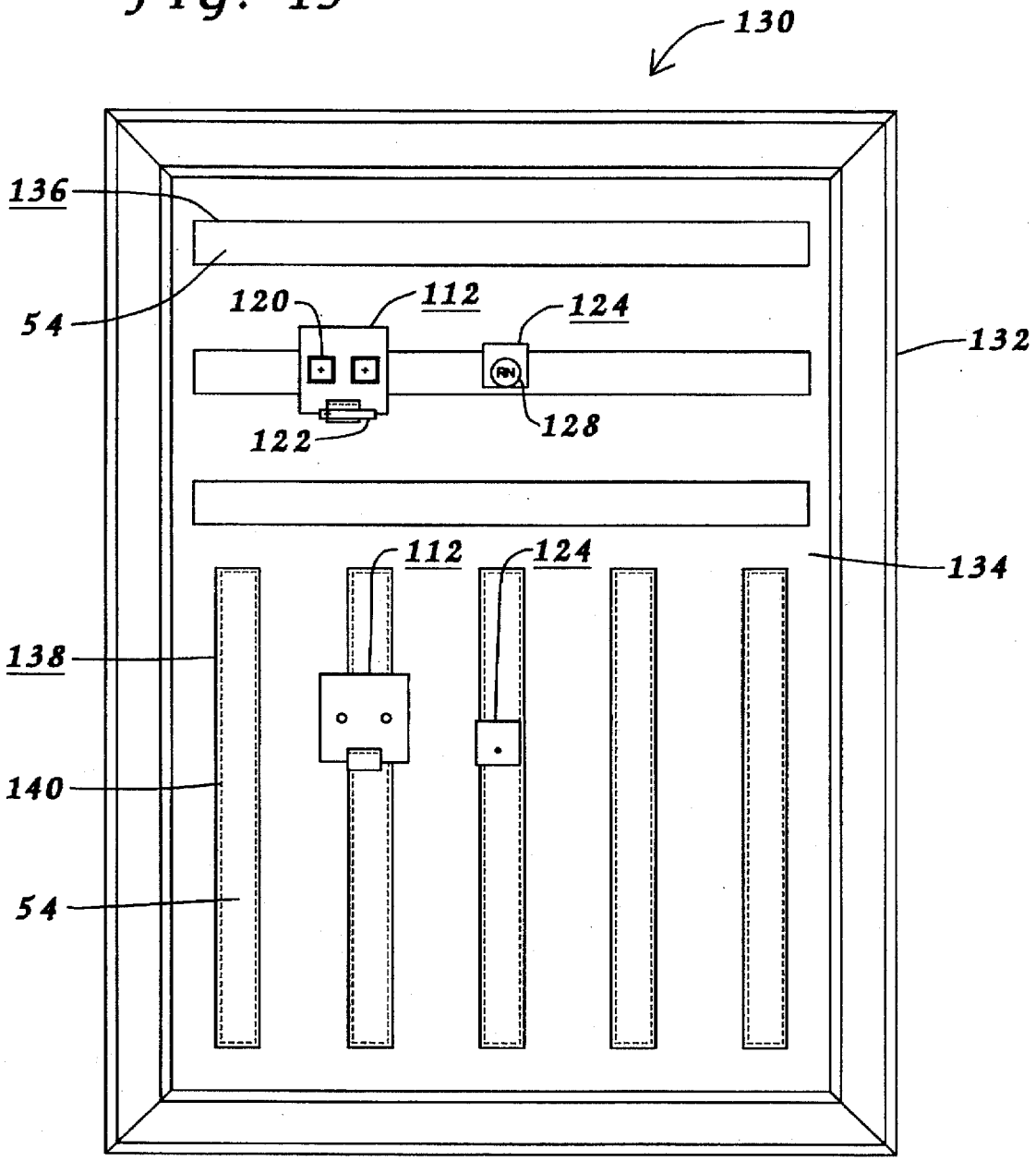
FIG. 13 is a front elevational view of a second embodiment of a display unit.

FIG. 13 examples such partial coverage. A display unit 130, comprising a frame 132 and a support surface 134, have loop material strips 136 and loop material strips 138 securely fixed to support surface 134. Partial coverage provides sufficient attachment area coverage while reducing material cost. Loop material strips 136, shown horizontally attached at upper frame 132, have exposed surfaces formed of loop material 54. Such attachment is exampled by gluing, not shown. Loop material strips 138, shown vertically attached at lower frame 132, have exposed surfaces formed of loop material 54. Such attachment is exampled by stitching 140 extending around the perimeter of each loop material strip 138.

Figure 14:
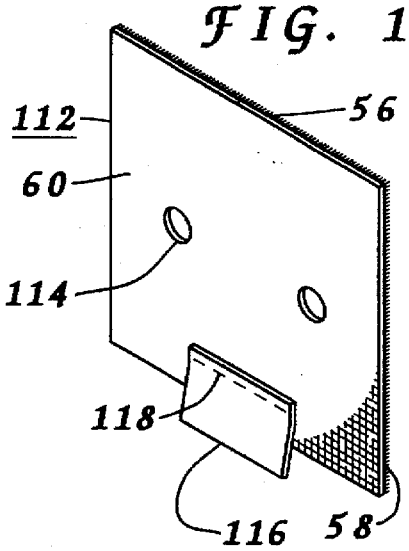
FIG. 14 is a perspective view of a cuff link holder unit.

FIG. 13 and FIG. 14 show a cuff link holder unit 112 adaptable to hold cuff links 120 and a tie clasp 122. Opposing penetrating apertures 114 permit insertion of cuff links 120 and retention using the securing members, not shown, of cuff links 120. An extending flap 116, secured to base side 60 using a stitching 118, permits attachment of tie clasp 122 using the securing member, not shown, of tie clasp 122.

Figure 15:
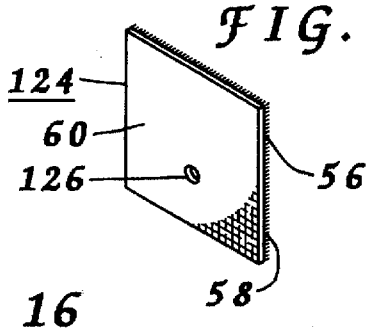
FIG. 15 is a perspective view of a identifying pin holder unit.

FIG. 13 and FIG. 15 show an identifying pin holder 124 adaptable to hold an identifying pin 128. A penetrating aperture 126 through identifying pin holder 124 permits insertion of the pin, not shown, and retention using the securing fastener, not shown, of identifying pin 128.

Figure 16:
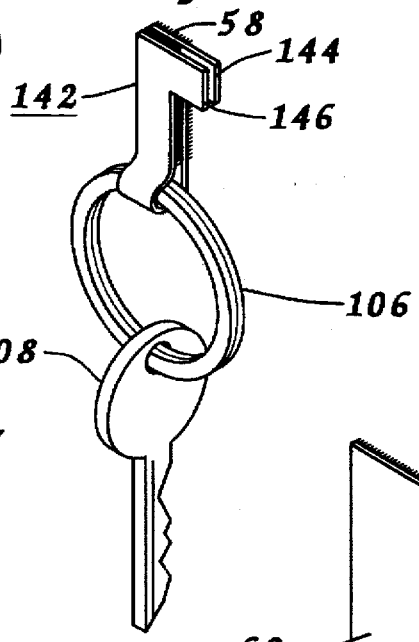
FIG. 16 is a perspective view of a second embodiment of a ring holder unit.
Figure 17:
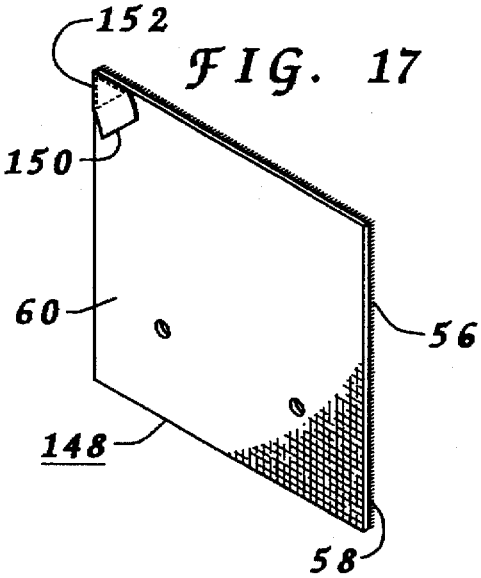
FIG. 17 is a perspective view of a holder unit.
Figure 18:
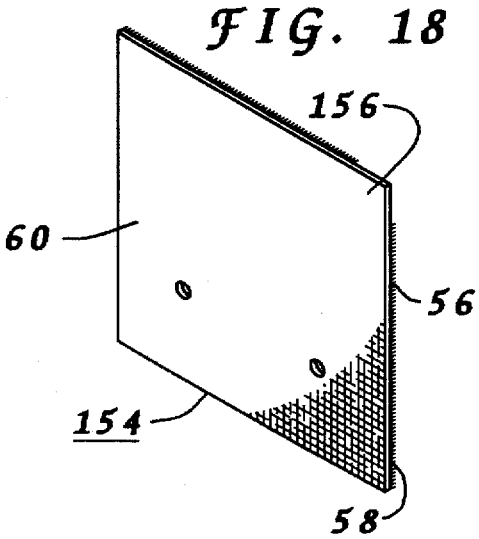
FIG. 18 is a perspective view of a holder unit.

FIG. 16 through FIG. 18 show several removal aids to permit easier removal of the various holder units from the particular display unit. Numerous other options exist and it is understood that the item holder units are shown as examples only. Similar removal aids may be applied to any of the holder units disclosed or their equivalents.

FIG. 16 illustrates a ring holder unit 142 having key ring 106 and key 108 attached thereto. A first pull tab 144 and a second pull tab 146 extend from opposing ends of ring holder unit 142. In the attached or closed position, as shown, first pull tab 144 and second pull tab 146 are aligned one to the other. First pull tab 144 and second pull tab 146 do not have either of the opposing fastener members on either of their respective exposed surfaces. Therefore there is no gripping either one to the other or to loop material 54 of the display unit.

FIG. 17 illustrates a holder unit 148 having a pull tab 150 attached to base side 60 using stitching 152. Pull tab 150 extends from base side 60 and is easily gripped by the user.

FIG. 18 illustrates a holder unit 154 having a grasp area 156 formed by a lack of hook material 56 extending from contact side 58 in this area. Contact side 58 will not adhere in this area with loop material 54 of the display unit. Therefore, gripping by the user is easily achieved.

Figure 20:
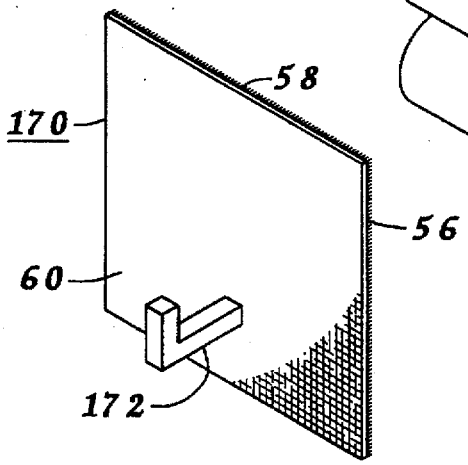
FIG. 20 is a perspective view of a hook holder unit.

A hook holder unit 170, shown in FIG. 20, having a hook 172 attached to base side 60, is adaptable to hold many different items. Hook holder unit 170 is an example of a holder unit not having item retention properties while in a detached state from the respective associative display unit. Hook holder unit 170 is designed to be moveable about the display unit by the user.

Figure 23:
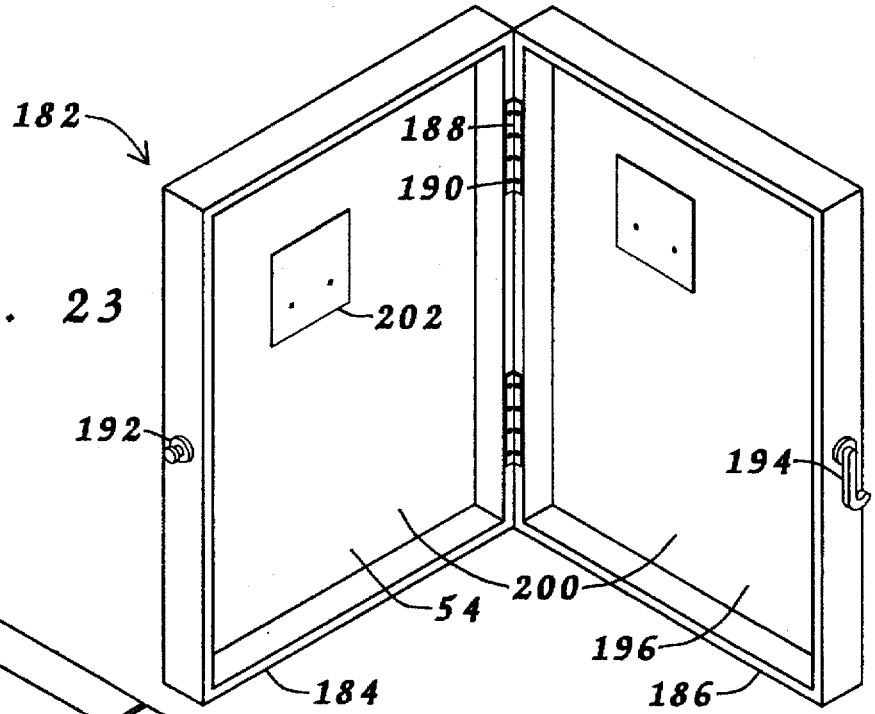
FIG. 23 is a front perspective view of a transportable display unit.
Figure 24:
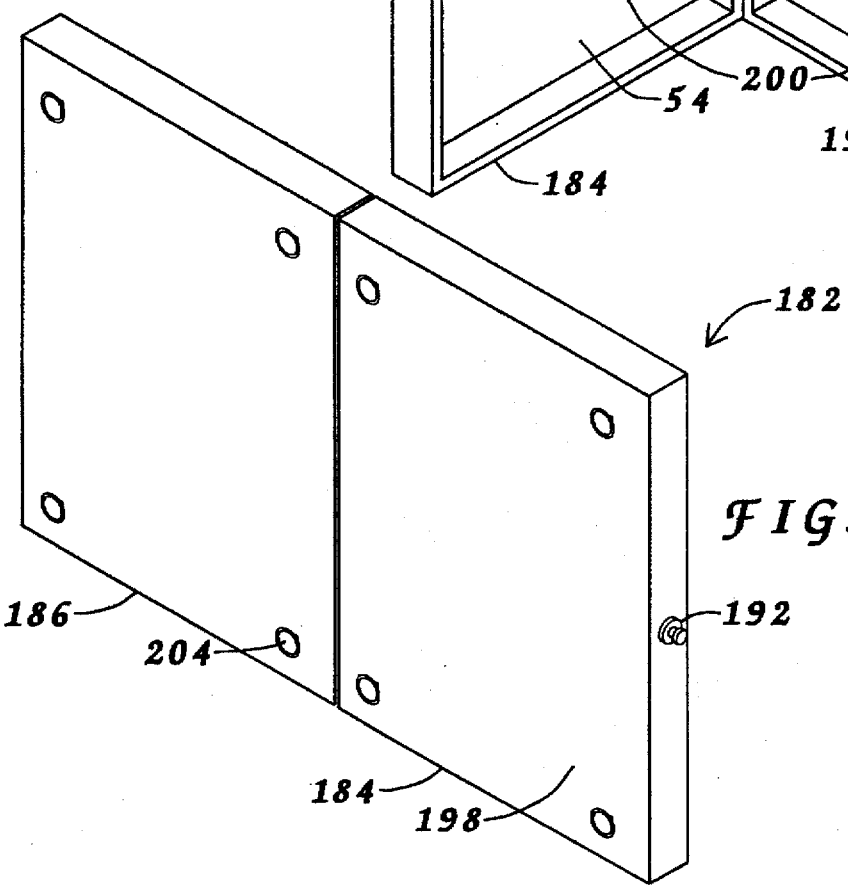
FIG. 24 is a rear perspective view of the transportable display unit shown in FIG. 23.
Figure 25:
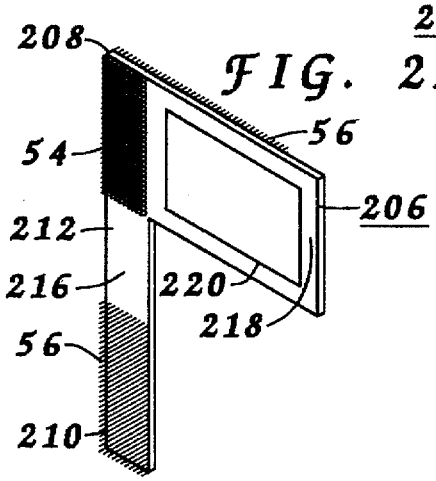
FIG. 25 is a front perspective view of a key ring holder unit.
Figure 26:
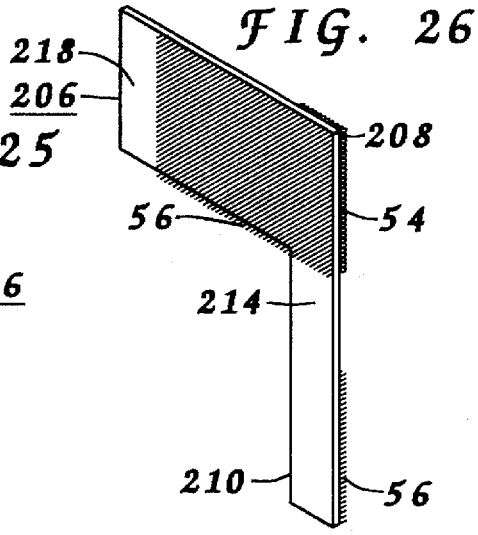
FIG. 26 is a rear perspective view of the key ring holder unit shown in FIG. 25.
Figure 27:
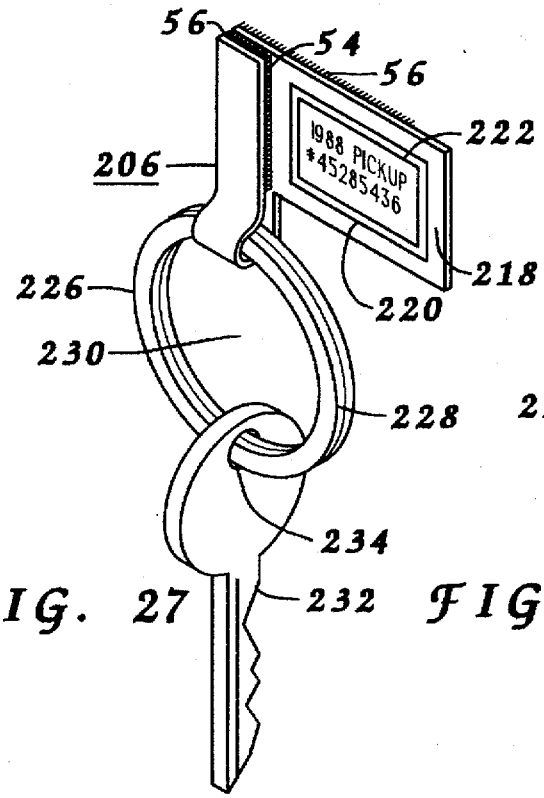
FIG. 27 a perspective view of the key ring holder unit shown in FIG. 25 and FIG. 26 with a key ring attached.
Figure 28:
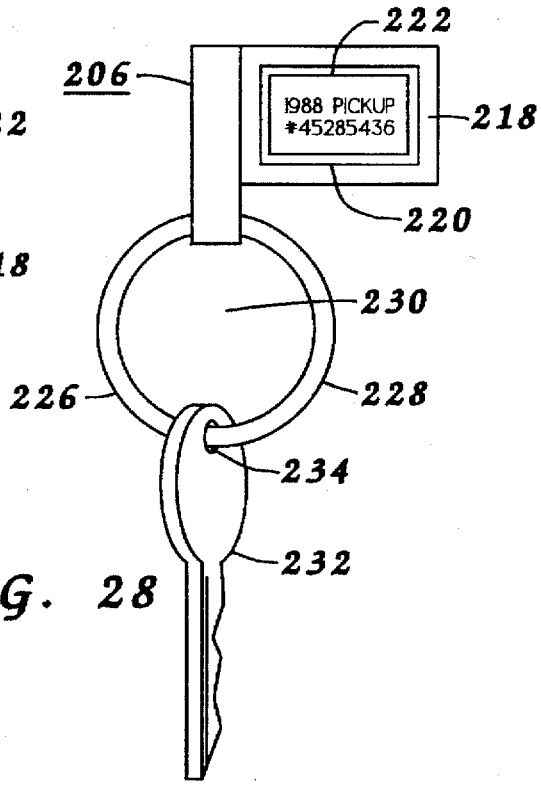
FIG. 28 is a front elevational view of the key ring holder unit shown in FIG. 27.
Figure 29:
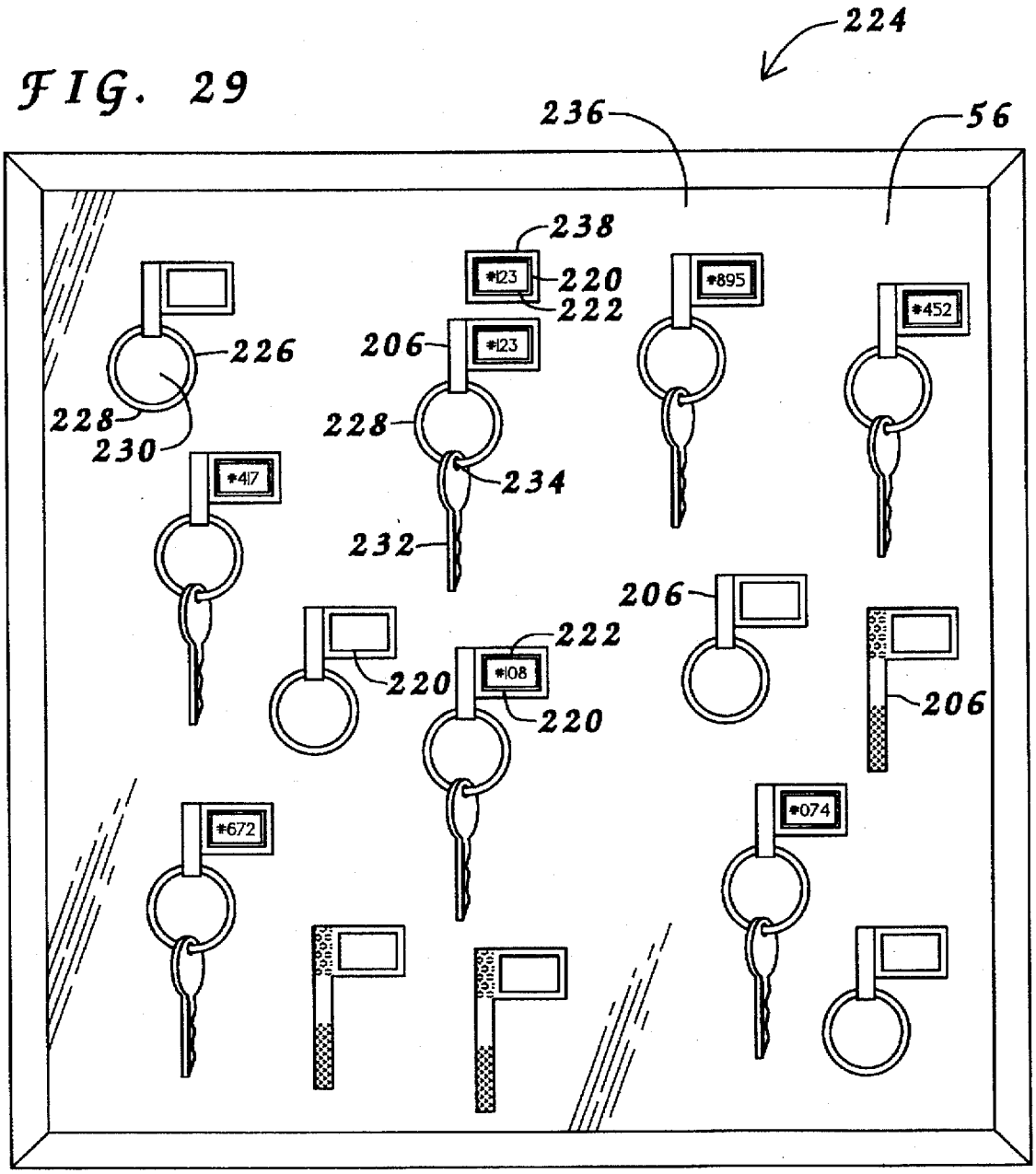
FIG. 29 is a front elevational view of a key display unit.

FIG. 23 and FIG. 24 depict a transportable display unit 182 comprised of a first cover 184 and a second cover 186. First cover 184 and second cover 186 are mounted one to the other using hinges 188 secured by screws 190. Transportable display unit 182 may be closed and secured shut using any locking means conventionally known in the art as exampled by a first locking member 192 and a second locking member 194. In this closed state, not shown, transportable display unit may be transported by the user.

Transportable display unit 182 has an interior 196, shown in FIG. 23 and an exterior 198, shown in FIG. 24. At least part of interior 196 comprises support surfaces 200 within first cover 184 and second cover 186. Covering support surfaces 200 is loop material 54. Various holder units, as exampled by earring holder unit 202, are mountable and dismountable from support surfaces 200.

Once at a location of use, transportable display unit 182 may be secured to a suitable smooth surface, such as a mirror, not shown. Such attachment being preferred for optimum functional use of transportable display unit 182. A particularly expedient attachment method is to utilize a plurality of suction cups 204 secured to exterior 198 of first cover 184 and second cover 186. Using the mirror, generally found in locations where people dress, transportable display unit 182 is fully functional for the user.

FIG. 25 through FIG. 29 illustrate a key ring holder unit 206. Keys are a class of items which are manipulated by people and, in certain situations, require repetitive identification, selection and handling. While numerous examples exist where numerous keys are handled by people two areas are easily identified. The first relates to automobiles and the second generally relates to real estate.

Automobiles each have at least one key associated with them. In certain situations vehicle keys are manipulated by persons other than the keys owner while the vehicle's keys are attached with other keys belonging to the vehicle owner. Several general areas where numerous vehicle keys are centrally collected include automobile dealers, rental agencies, repair shops, valet parking, impound lots and fleet lots, such as police agencies.

Real estate, as it is associated with buildings, have many situations where numerous keys are centrally collected. Several examples include property for sale by realtors, rental managers, mobile home dealers and motels or hotels.

In each of the above situations it is generally necessary to have a central area where the keys are stored. In this location the keys generally are labeled and stored in an orderly fashion, all labels visible and all keys easily accessible.

Key ring holder unit 206 comprises a first side 212, a second side 214, a first end 208, a second end 210 and an extension area having a grasp area 218 extending adjacent first end 208. Securely attached in close proximity to first end 208 on first side 212 is loop material 54. Securely attached in close proximity to second end 210 on first side 212 is hook material 56. Situated on first side 212 between loop material 54 and hook material 56 is a ring area 216. Securely attached between loop material 54 and grasp area 218 on first side 212 is a label holder 220. Label holder 220 comprises a covered envelope open at one end as conventionally known in the art. Label holder 220 has a transparent material covering thereon and permits viewing of a label 222 contained therein. Label 222 is user labeled to identify the associative attached keys.

Securely attached in close proximity to first end 208 on second side 214 and extending outward to grasp area 218 is hook material 56. Hook material 56 situated on second side 214 permits attachment of key ring holder unit 206 to a key display unit 224, shown in FIG. 29.

Key ring holder unit 206 has the purpose of securely containing a key ring 226 formed of an encircling band 228. Key ring 226 is adaptable to hold at least one key 232 attached thereto using a penetrating aperture 234 of each key 232. Encircling band 228 forms an aperture 230 into which is inserted second end 210 of key ring holder unit 206. Following such insertion second end 210 of first side 212 is brought upward and placed in contact with first end 208 of first side 212. Hook material 56 and loop material 54 attach one to the other and key ring 226 is retained in ring area 216.

Key display unit 224 has a support surface 236 which is covered by hook material 56. Attachment of key ring holder unit 206 is facilitated by hook material 56 attached to second side 214. Grasp area 218 is an area on key ring holder unit 206 comprising an area on first side 212 and second side 214. Grasp area 218 does not attach itself to key display unit 224 due to the lack of an attachment member thereon on second side 214. This provides for easy access and grasping by the user removing key ring holder unit 206 from support surface 236 of key display unit 224.

An identifying label holder 238 is provided having opposing sides with label holder 220 attached to one side. The opposing side, not shown, is partially covered by hook material 54. A label 222 can be inserted within label holder 220 of identifying label holder 238. Identifying label holder 238 may be attached to support surface 236 of key display unit 224. Such labeling to identify a corresponding location for a key ring holder unit 206 or grouping thereof. Identifying label holder 238 is user positioned and moveable about key display unit 224.

While a single planar surface is disclosed as forming the support surface, many shapes and configurations are envisioned. One has several planar surfaces terraced as exampled by 10% offsets from vertical. Such a display unit could have lighting hidden behind the lower edge of one extending planar surface to illuminate the next lower planar surface. Due to the flexibility of the holder units, arched, rounded or globular shapes are possible, envisioned and disclosed.

A particularly desirable configuration has a clear or translucent panel forming the support surface. This panel then has one member of the dual fastener attached thereto providing partial intermittent coverage. Finally a light source is positioned so as to illuminate behind the clear or translucent panel. As an enhancement to this configuration, or any of the others, the individual holder units may be formed of a clear or translucent flexible material. The second member of the dual fastener providing partial coverage to the rear of each of these holder units. As an additional enhancement to this configuration changeable backing material having distinctive patterns could be applied behind the clear or translucent panel for aesthetic appeal.

Frames having different styles than the planar bordered types illustrated are envisioned. Cabinet styles having doors would provide for concealment of the items mounted within without necessitating movement of the individual items. Various deployment of mirrors and or lighting could provide display units suitable to users having varied style preferences and budgets.

As an example, one group of users may prefer items directed toward the country western style. A display unit having a border formed of rope rather than framing trim may provide the proper feel to match such a style. Other modifications to match style preferences are easily envisioned and satisfied.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling with the scope of the invention.

I claim:

1. A display unit for display of items, each item having an attachment member, the attachment member of the item providing securement means, the display unit comprising:

a) an opposing detachable fastener having a first member and a second member, the first member having an adhesion contact side and a base side, the second member having an adhesion contact side and a base side, the first member and the second member cooperating to provide detachable attachment means, the detachable attachment means having an attached state and a detached state, the attached state providing adhesion while the adhesion contact side of the first member and the adhesion contact side of the second member are in contact, the detached state providing for complete separation or the first member and the second member;

b) a support surface having at least one piece of the first member of the opposing detachable fastener rigidly secured thereto and at least partially coverting the support surface with the adhesion contact side of the first member of the opposing detachable fastener exposed;

c) a plurality of detachable holder units, each detachable holder unit; having a display attachment side and an item mounting side, the display attachment side providing for secured exposure of the adhesion contact side of the second member of the opposing detachable fastener, wherein, utilizing the second member of the opposing detachable fastener each detachable holder unit may be repeatedly dismounted and remounted at any select unoccupied location on the support surface, the item mounting side providing for contact by the item, each holder unit having attachment means, the attachment means comprising at least one aperture and providing for securement of the item to the item mounting side of the holder unit utilizing the attachment member of the item;

whereby items may be attached to the individual detachable holder units and each of the detachable holder units may be repeatedly dismounted from the support surface of the display unit and remounted at any select unoccupied location on the support surface of the display unit.

2. The display unit defined in claim 1 wherein at least one of the holder units comprises an earring pad, the earring pad adaptable to receive and retain a pair of pierced type earrings, the pierced type earrings each having a shaft and a connector, the shaft and the connector cooperating to retain the pierced type earrings to a wearer, the earring pad having two penetrating apertures, each penetrating aperture to receive inserted therethrough the shaft of one of the pierced type earrings while being retained therein by the connector.

3. The display unit defined in claim 1 wherein at least one of the holder units comprises an earring pad, the earring pad adaptable to receive and retain a pair of clip on type earrings, the clip on type earrings each having a resilient clip for retaining the clip on type earrings to a wearer, the earring pad having an extending connection member, the extending connection member secured to the item mounting side and extending therefrom, the extending connection member to receive the resilient clip of each clip on type earring.

4. The display unit defined in claim 1 wherein at least one of the holder units comprises a loop item holder, the loop item holder adaptable to receive and retain a loop item jewelry piece, the loop item jewelry piece having a closed state and a penetrating opening while in the closed state, the loop item holder having an extending support arch, a fastening strap and a fastening strip, the extending support arch rigidly secured to the item mounting side and extending therefrom, the fastening strap having a first end and a second end, the first end secured to the item mounting side adjacent to and to one side of the extending support arch, the second end having a first side and a second side, the first side comprising an adhesion contact side, the fastening strip secured to the item mounting side adjacent to and to the other side of the extending support arch from the first end of the fastening strap, the fastening strip comprising an adhesion contact side, the adhesion contact side of the fastening strap and the adhesion contact side of the fastening strip cooperating to provide detachable securement of the second end of the fastening strap to the fastening strip following insertion through the penetrating opening of the loop item.

5. The display unit defined in claim 1 further comprising a ring holder unit, the ring holder unit to hold a ring, the ring having an encircling band forming an aperture, the ring holder unit having a length and a width, the length significantly greater than the width, the ring holder unit having a first end and a second end disposed along the length, the first end having a first side and a second side, the first side of the first end comprising an adhesion contact side, the second side of the first end comprising an adhesion contact side, the second end having a first side and a second side, the first side of the second end comprising an adhesion contact side, the first side of the first end and the first side of the second end cooperating to adhere and contain the ring while in contact while the ring holder unit penetrates the aperture of the ring with the first end of the ring holder unit and the second end of the ring holder unit on opposing sides of the aperture of the ring, the adhesion contact side of the second side of the first end providing for detachable attachment to the support surface.

6. The display unit defined in claim 1 further comprising a detachable holder, the detachable holder having an attachment side and a holder unit mounting side, the attachment side comprising the adhesion contact side of the second member of the opposing detachable fastener, the holder unit mounting side comprising the adhesion contact side of the first member of the opposing detachable fastener, the detachable holder to provide for detachable attachment of a plurality of the holder units to the holder unit mounting side of the detachable holder and detachable attachment to the support surface using the attachment side of the detachable holder; whereby the detachable holder is removable from the support surface with select holder units attached thereto for transport of the select holder units while providing containment of the select holder units and any item secured thereto.

7. The display unit defined in claim 1 wherein a plurality of the first members of the opposing detachable fastener are rigidly secured to the support surface and partially covers the support surface.

8. The display unit defined in claim 1 wherein a single sheet of the first member of the opposing detachable fastener is rigidly secured to the support surface and completely covers the support surface.

9. The display unit defined in claim 1 wherein each of the holder units further comprises gripping means, the gripping means providing for ease of access to begin removal of the holder unit from the support surface.

10. A jewelry display unit providing for detachable attachment of jewelry items by a user and for visual inspection of the jewelry items by the user, each jewelry item having a fastener, the jewelry display unit comprising:

a) a hook and loop fastener having a first sheet and a second sheet, the first sheet flexible and resilient and having an adhesion side and a base side, the second sheet flexible and resilient and having an adhesion side and a base side, the adhesion side of the first sheet and the adhesion side of the second sheet cooperating when in contact to provide adhesion between the first sheet and the second sheet;

b) a frame unit having a perimeter and a support surface, the perimeter formed by decorative trimming, the support surface bordered by the perimeter and having a display side, the display side at least partially covered by at least one piece of the first sheet of the hook and loop fastener with the adhesion side exposed, the base side of the first sheet of the hook and loop fastener securely affixed to the display side of the support surface;

c) display positioning means to provide for stationary positioning of the frame unit by the user;

d) a plurality of detachable jewelry holder units, each detachable jewelry holder unit capable of display of at least one of the jewelry items each detachable jewelry holder unit having a display side, an adhesion side and an attachment member, the display side providing at least one aperture for securement thereto by at least one of the jewelry items, the securement utilizing the attachment member of the jewelry holder unit and the fastener of the jewelry item, the adhesion side of each jewelry holder unit providing for secure exposure therefrom of the adhesion side of the second sheet of the hook and loop fastener, wherein each detachable jewelry holder unit may be repeatedly detached from the support surface and reattached at any select unoccupied location on the the support surface;

whereby the individual detachable jewelry holder units may have jewelry attached thereto and the detachable jewelry holder units may be selectively attached to the support surface of the frame unit at any select unoccupied location and selectively detached repeatedly.

11. The jewelry display unit defined in claim 10 wherein at least one of the jewelry holder units comprises an earring pad, the earring pad adaptable to receive and retain a pair of pierced type earrings, the pierced type earrings each having a shaft and a connector, the shaft and the connector cooperating to retain the pierced type earrings to a wearer, and wherein the attachment member comprises two penetrating apertures, each penetrating aperture to receive inserted therethrough the shaft of one of the pierced type earrings while being retained therein by the connector.

12. The jewelry display unit defined in claim 10 wherein at least one of the jewelry holder units comprises an earring pad, the earring pad adaptable to receive and retain a pair of clip on type earrings, the clip on type earrings each having a resilient clip for retaining the clip on type earrings to a wearer, and wherein the attachment member comprises an extending connection member, the extending connection member secured to the item mounting side and extending therefrom, the extending connection member to receive the resilient clip of each clip on type earring.

13. The jewelry display unit defined in claim 10 wherein at least one of the jewelry holder units comprises a loop item holder, the loop item holder adaptable to receive and retain a loop item jewelry piece, the loop item jewelry piece having a closed state and while in the closed state a penetrating opening, and wherein the attachment member comprises an extending support arch, a fastening strap and a fastening strip, the extending support arch rigidly secured to the display side and extending therefrom, the fastening strap having a first end and a second end, the first end secured to the display side adjacent to and to one side of the extending support arch, the second end having a first side and a second side, the first side comprising an adhesion contact side, the fastening strip secured to the display side adjacent to and to the other side of the extending support arch, the fastening strip comprising an adhesion contact side, the adhesion contact side of the fastening strap and the adhesion contact side of the fastening strip cooperating to provide detachable securement of the second end of the fastening strap to the fastening strip.

14. The jewelry display unit defined in claim 10 further comprising a ring holder unit, the ring holder unit to hold a ring, the ring having an encircling band forming an aperture, the ring holder unit having a length and a width, the length significantly greater than the width, the ring holder unit having a first end and a second end disposed along the length, the first end having a first side and a second side, the first side of the first end comprising an adhesion contact side, the second side of the first end comprising an adhesion contact side, the second end having a first side and a second side, the first side of the second end comprising an adhesion contact side, the first side of the first end and the first side of the second end cooperating to adhere and contain the ring while in contact while the ring holder unit penetrates the aperture of the ring with the first end of the ring holder unit and the second end of the ring holder unit on opposing sides of the aperture of the ring, the adhesion contact side of the second side of the first end providing for detachable attachment to the support surface of the frame unit.

15. The jewelry display unit defined in claim 10 further comprising a detachable holder, the detachable holder having an attachment side and a jewelry holder unit mounting side, the attachment side comprising the adhesion side of the second sheet.

* * * * *